US009896883B1

(12) United States Patent
Cheng

(10) Patent No.: US 9,896,883 B1
(45) Date of Patent: Feb. 20, 2018

(54) COILABLE SHADE

(71) Applicant: Li-Ming Cheng, Kaohsiung (TW)

(72) Inventor: Li-Ming Cheng, Kaohsiung (TW)

( * ) Notice: Subject to any disclaimer, the term of this patent is extended or adjusted under 35 U.S.C. 154(b) by 0 days.

(21) Appl. No.: 15/237,688

(22) Filed: Aug. 16, 2016

(51) Int. Cl.

| | |
|---|---|
| ***E06B 9/24*** | (2006.01) |
| ***E06B 9/80*** | (2006.01) |
| ***E06B 9/42*** | (2006.01) |
| ***E06B 9/44*** | (2006.01) |
| ***E06B 9/64*** | (2006.01) |
| ***E06B 9/66*** | (2006.01) |

(52) U.S. Cl.
CPC ..... *E06B 9/80* (2013.01); *E06B 9/42* (2013.01); *E06B 9/44* (2013.01); *E06B 9/64* (2013.01); *E06B 9/66* (2013.01)

(58) Field of Classification Search
CPC ..... E06B 9/44; E06B 9/42; E06B 9/64; E06B 9/66; E06B 9/78; E06B 9/80
USPC ..... 160/245
See application file for complete search history.

(56) References Cited

U.S. PATENT DOCUMENTS 201,710 A * 3/1878 Shaw ..... E06B 9/42 160/245
467,385 A * 1/1892 Spencer ..... E06B 9/42 160/120
530,079 A * 12/1894 Bergstresser ..... E06B 3/2605 160/245
628,075 A * 7/1899 Crocker ..... E06B 3/2605 160/245
1,435,426 A * 11/1922 Spencer ..... E06B 9/42 160/245
5,913,564 A * 6/1999 Stewart ..... B60J 1/14 160/120
6,644,379 B1 * 11/2003 Nei ..... E06B 9/323 160/243
7,302,738 B2 * 12/2007 Nien ..... E06B 9/326 160/178.1 R
8,205,657 B2 * 6/2012 Bohlen ..... E06B 9/42 160/245
2013/0081766 A1 * 4/2013 Bourdon ..... E06B 9/24 160/127
2013/0269885 A1 * 10/2013 Cavarec ..... E06B 9/64 160/311

* cited by examiner

*Primary Examiner* — Katherine W Mitchell
*Assistant Examiner* — Abe Massad
(74) *Attorney, Agent, or Firm* — Alan D. Kamrath; Kamrath IP Lawfirm, P.A.

(57) ABSTRACT

A coilable shade includes a shade having a head end and a tail end. The head end includes a hanger portion. A shaft is fixed to the tail end of the shade. A shade holding device includes two pivotal portions opposite to each other. The shaft is coupled to the two pivotal portions. A portion of the shade coiled around the shaft is received in the shade holding device and is held by an elastic enveloping strap. The disadvantage of failure in retaining in a desired length in the conventional shade device that can only provide a fully extended state or a fully coiled state is, thus, solved.

3 Claims, 5 Drawing Sheets

COILABLE SHADE

BACKGROUND OF THE INVENTION

1. Field of the Invention

The present disclosure relates to a coilable shade and, more particularly, to a coilable shade that can be coiled upward.

2. Description of the Related Art

A type of conventional shade device includes a shade having upper and lower ends respectively fixed to upper and lower rods. A plurality of hangers is fixed to the upper rod for hanging above an opening (for a door or a window) by hooks. The shade can be extended to shield the opening. When it is desired to reveal the opening, the lower rod can be moved upward toward the upper rod to coil the shade, and a strap is used to tie the lower rod.

However, the conventional shade device can only provide a fully extended state or a fully coiled state. Namely, the conventional shade device cannot be retained in any desired length, providing poor use convenience. Improvement is, thus, required.

SUMMARY OF THE INVENTION

An objective of the present disclosure is to provide a coilable shade including a shade that can be retained in any desired length under control.

A coilable shade according to the present disclosure includes a shade having a head end and a tail end. The head end includes a hanger portion. A shaft is fixed to the tail end of the shade. A shade holding device includes two pivotal portions opposite to each other. The shaft is coupled to the two pivotal portions. A portion of the shade coiled around the shaft is received in the shade holding device and is held by an elastic enveloping strap.

The shade of the coilable shade according to the present disclosure can be controlled to be retained in any desired extended length through simple operation while providing excellent use convenience as well as fulfilling different shielding effects. Thus, the coilable shade has excellent utility.

The shade holding device can further include two lateral boards opposite to each other and two rods. The two pivotal portions are disposed on two mutually facing sides respectively of the two lateral boards. Two ends of each of the two rods are respectively fixed to the two lateral boards. The elastic enveloping strap includes a first end fixed between the two ends of one of the two rods and a second end having a hook detachably coupled between the two ends of another of the two rods. The structure is simple and is easy to manufacture and assemble, reducing the manufacturing costs and increasing assembling convenience.

The two rods are more adjacent to the head end of the shade than the two pivotal portions are to the head end of the shade. Thus, the portion of the shade coiled around the shaft can be more securely received in the shade holding device.

Furthermore, the coilable shade can further include an elastic element. The elastic element includes a first end mounted in an interior of the shaft and a second end coupled to one of the two pivotal portions. This structure increases operational convenience while coiling the shade.

DETAILED DESCRIPTION OF THE INVENTION

The present disclosure will become clearer in light of the following detailed description of illustrative embodiments of this disclosure described in connection with the drawings.

Figure 1:
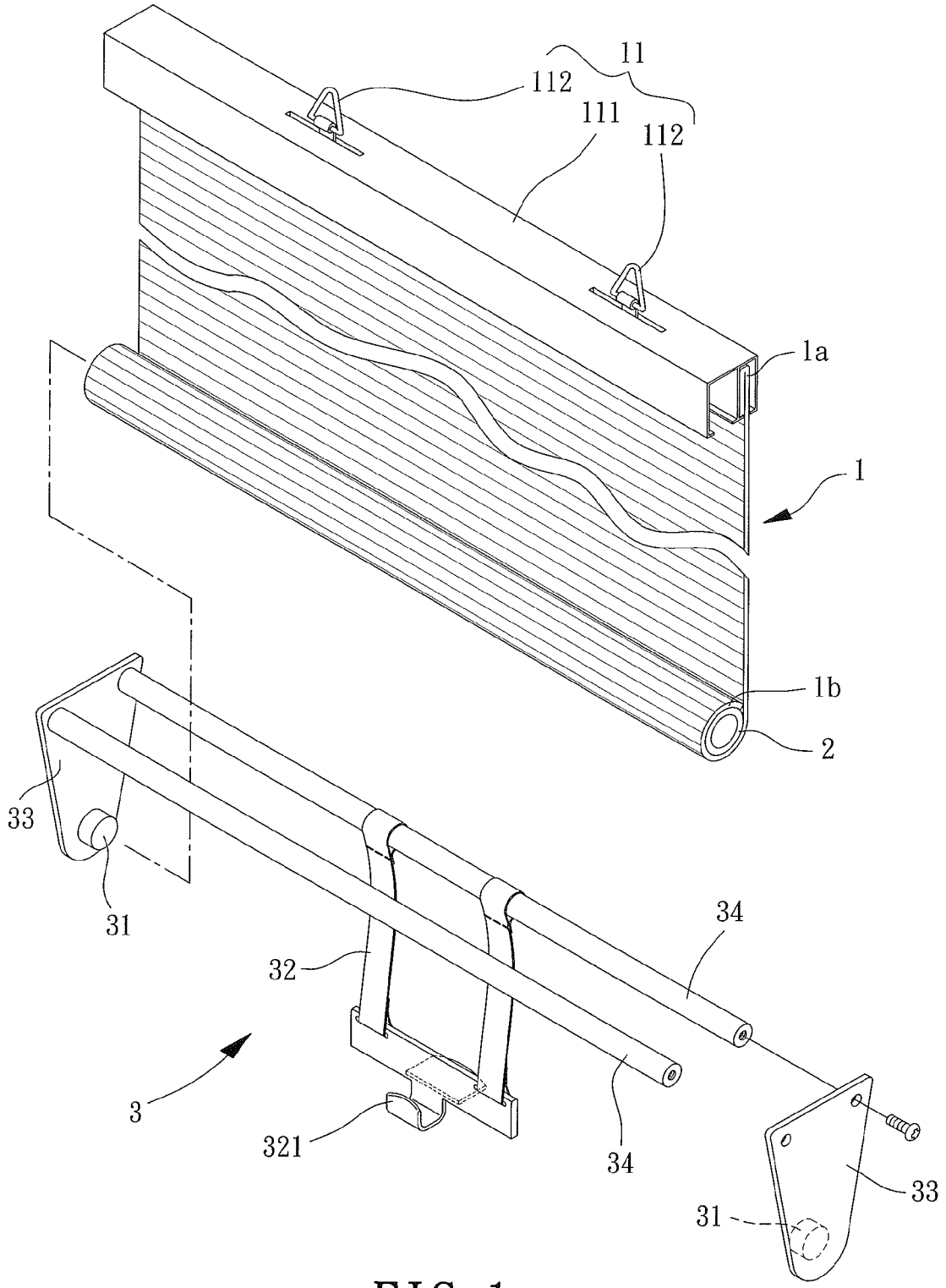
FIG. 1 is a diagrammatic exploded, perspective side view of a coilable shade of a first embodiment according to the present disclosure.

With reference to FIG. 1, a coilable shade of a first embodiment according to the present disclosure includes a shade 1, a shaft 2 and a shade holding device 3. The shaft 2 is fixed to the shade 1 and is pivotably connected to the shade holding device 3.

The shade 1 can be of any desired type, such as a piece of wood or constructed by a plurality of wood pieces, or a piece of cloth. The shade 1 includes a head end 1*a* and a tail end 1*b*. The head end 1*a* includes a hanger portion 11 for hanging above an opening (for a door or a window) by hooks, such that the opening can be shielded when the shade 1 is extended. In this embodiment, the hanger portion 11 includes a fixing rod 111 and a plurality of hangers 112. The head end 1*a* of the shade 1 can be fixed to the fixing rod 111. The hangers 112 are fixed to a top face of the fixing rod 111. The hangers 112 can be hung onto nails or hooks at an opening of a building.

The shaft 2 is fixed to the tail end 1*b* of the shade 1 and permits the shade 1 to be coiled upward.

The shade holding device 3 is used to support a bottom-most portion of the coilable shade according to the present disclosure to retain the shade 1 in any desired length in an extended state. The shade holding device 3 includes two pivotal portions 31 opposite to each other for pivotal connection with the shaft 2. A portion of the shade 1 coiled around the shaft 2 is received in the shade holding device 3 and is held by an elastic enveloping strap 32 to temporarily stop release of the shade 1.

More specifically, in this embodiment, the shade holding device 3 further includes two lateral boards 33 opposite to each other and two rods 34. The two pivotal portions 31 are disposed on two mutually facing sides respectively of the two lateral boards 33. Two ends of each of the two rods 34 are respectively fixed to the two mutually facing sides of the two lateral boards 33. The elastic enveloping strap 32 includes a first end fixed between the two ends of one of the two rods 34 and a second end having a hook 321 detachably coupled between the two ends of the other of the two rods 34.

Figure 2:
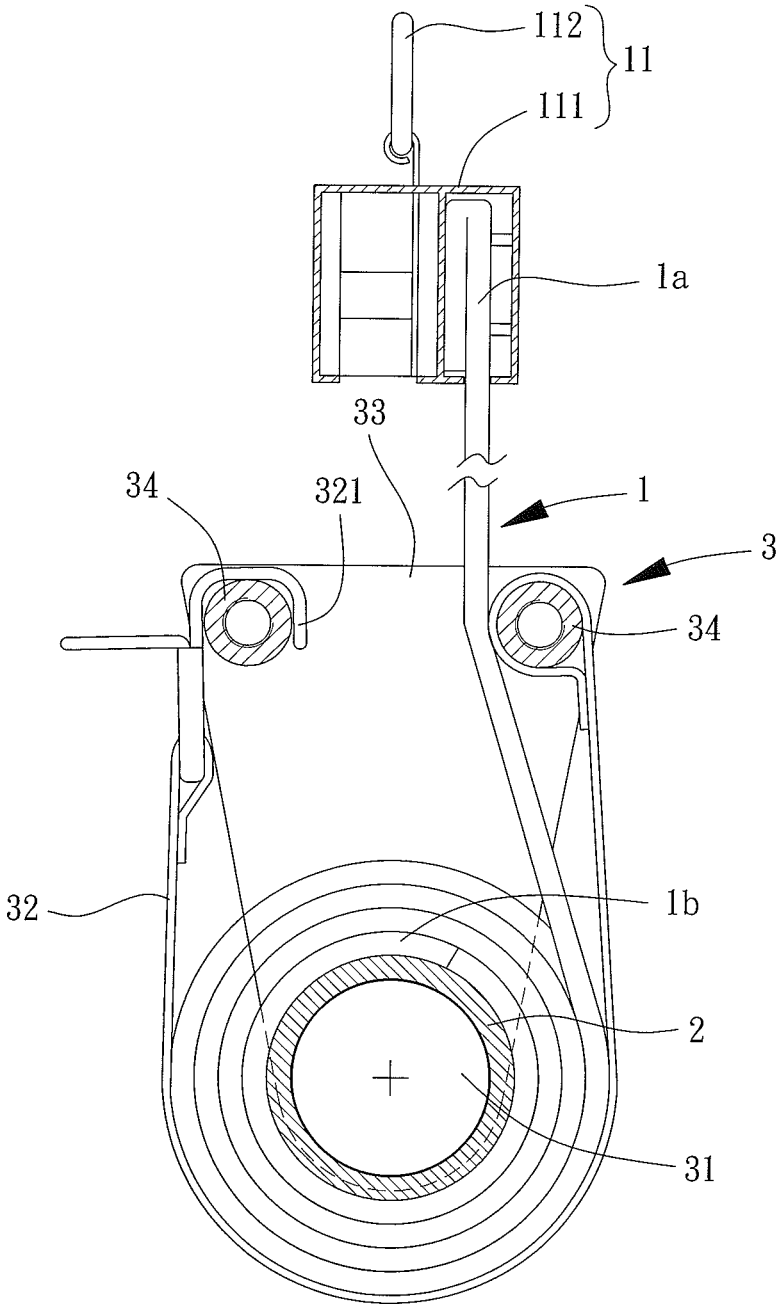
FIG. 2 is a cross sectional view of the coilable shade of FIG. 1.

With reference to FIGS. 1 and 2, the two rods 34 are preferably located between the two pivotal portions 31 and the head end 1*a* of the shade 1. Thus, the two rods 34 are located on front and rear sides of the shade 1 after assembly. Furthermore, the elastic enveloping strap 32 can envelope the rear side, the bottom side, and the front side of the shade 1 from below the coilable shade, such that the portion of the shade 1 coiled around the shaft 2 can be more securely received in the shade holding device 3.

According to the above structure, when it is desired to shorten the extended length of the shade 1, the hook 321 of the elastic enveloping strap 32 is detached from the corresponding rod 34, and the shade 1 is manually coiled to the desired length. Then, the hook 321 of the elastic enveloping strap 32 reengages with the corresponding rod 34. Thus, the portion of the shade 1 coiled around the shaft 2 can be reliably retained by the elasticity of the elastic enveloping strap 32, thereby retaining the shade 1 in the extended length.

On the other hand, if it is desired to increase the extended length of the shade 1, the hook 321 of the elastic enveloping strap 32 is detached from the corresponding rod 34, and the bottommost portion of the shade 1 is easily pulled downward under the assistance of the gravity (such as pulling the lateral boards 33 or the rods 34 of the shade holding device 3), and the shaft 2 is rotated to extend the shade 1. After the shade 1 has been extended to the desired length, the hook 321 of the elastic enveloping strap 32 reengages with the corresponding rod 34. Thus, the portion of the shade 1 coiled around the shaft 2 can be reliably retained by the elasticity of the elastic enveloping strap 32, thereby preventing further extending of the shade 1. Thus, in addition to the fully extended state and the fully coiled state, the coilable shade according to the present disclosure can be retained in any extended length to fulfill different needs.

Figure 3:
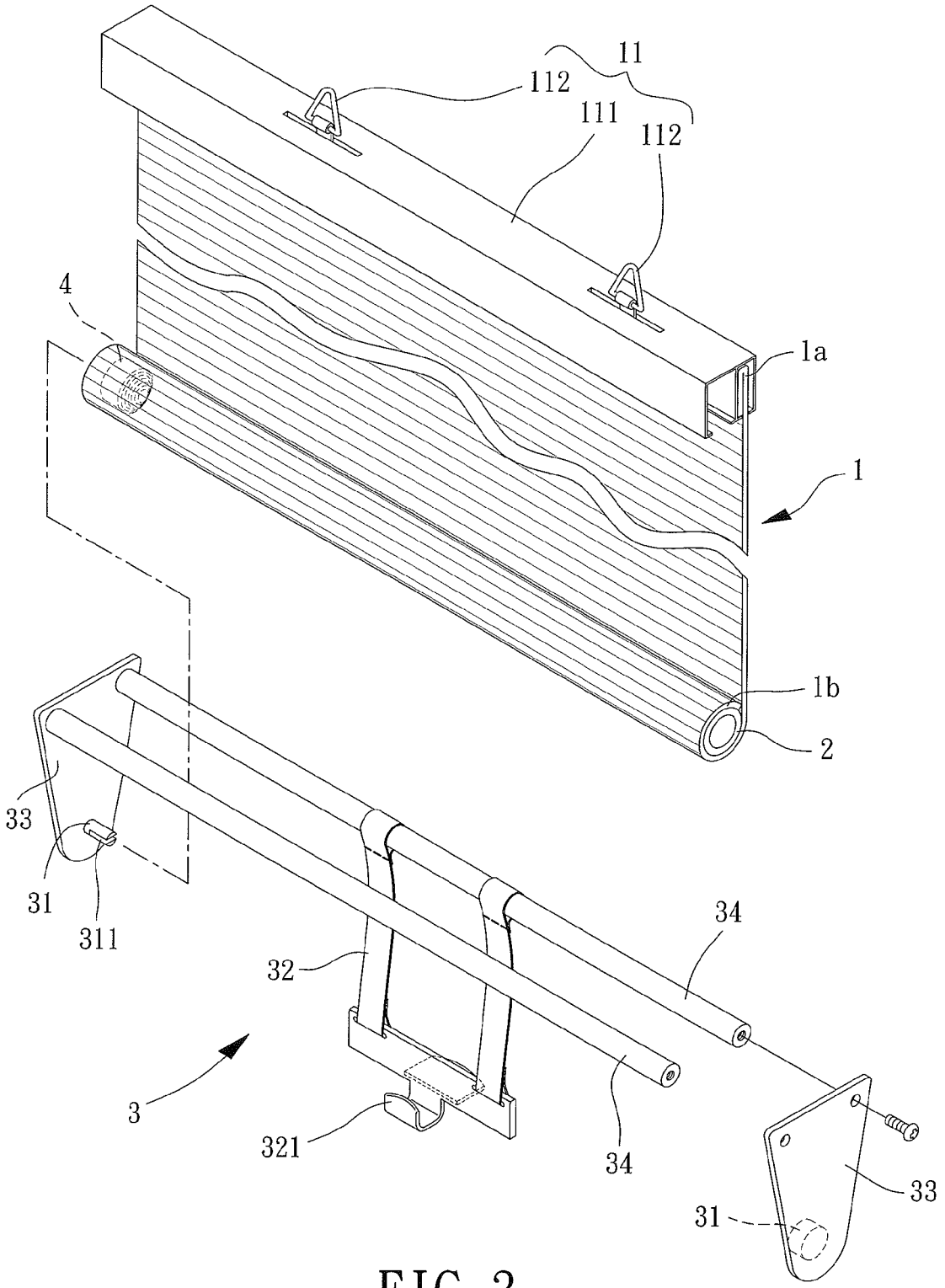
FIG. 3 is diagrammatic exploded, perspective side view of a coilable shade of a second embodiment according to the present disclosure.

FIG. 3 shows a coilable shade of a second embodiment according to the present disclosure. The second embodiment is substantially the same as the first embodiment. The main differences are that the coilable shade of the second embodiment further includes an elastic element 4 mounted in the shaft 2 to increase operational convenience while coiling the shade 1.

Figure 4:
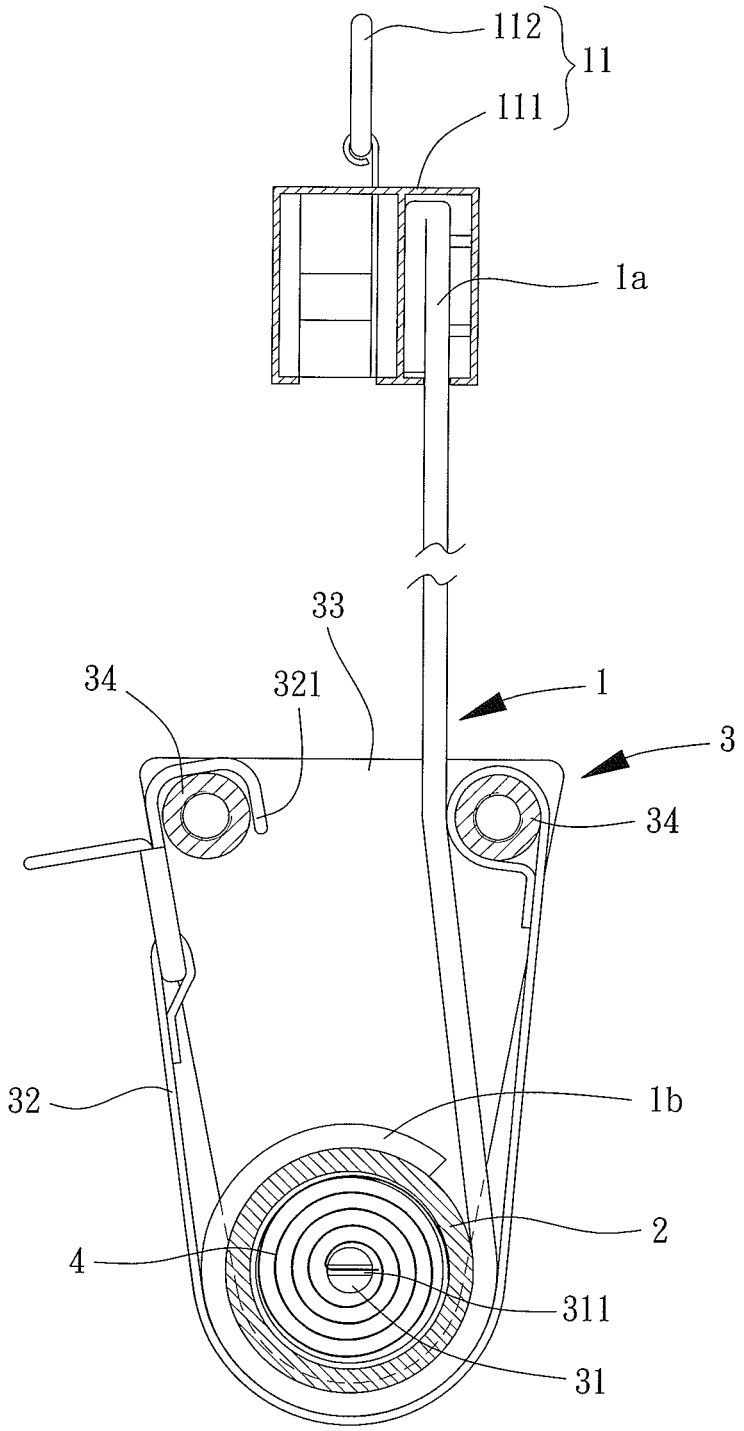
FIG. 4 is a cross sectional view of the coilable shade of FIG. 3.

With reference to FIGS. 3 and 4, a first end of the elastic element 4 is mounted in an interior of the shaft 2. One of the two pivotal portions 31 includes a notch 311 for coupling with a second end of the elastic element 4. Thus, when the shade 1 is being extended, the elastic element 4 deforms and stores elastic energy while the shaft 2 is being rotated. When the shade 1 is moved upward, the elastic returning force of the elastic element 4 rotates the shaft 2 in the reverse direction to automatically coil the shade 1, and the shade holding device 3 moves upward while the shade 1 is automatically coiled. As a non-restrictive example, the elastic element 4 can be a vortex spring or a torsion spring to store and release energy by coiling.

Figure 5:
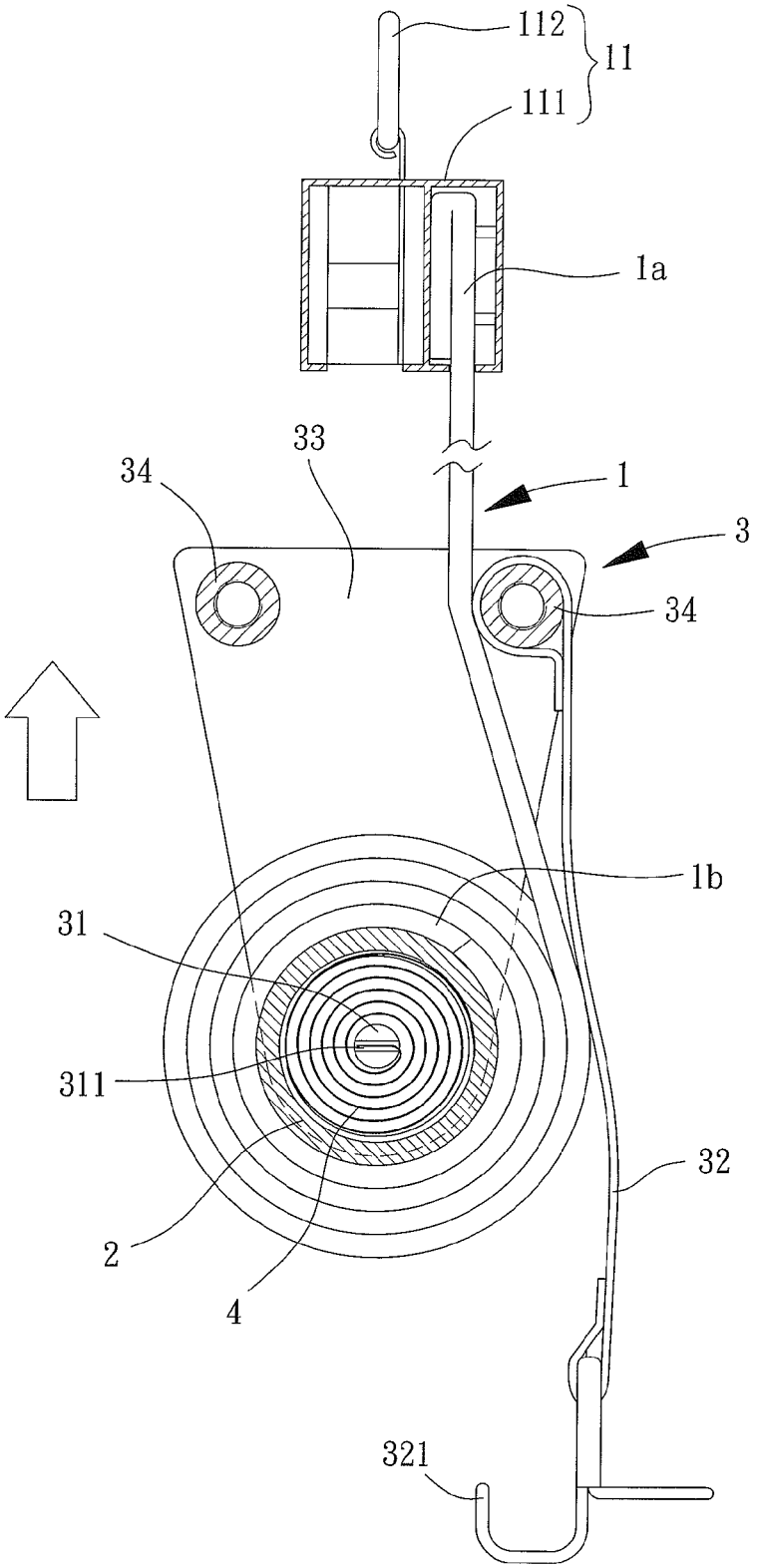
FIG. 5 is a diagrammatic view illustrating upward coiling of a shade of the coilable shade of FIG. 3.

More specifically, with reference to FIG. 5, when it is desired to shorten the extended length of the shade 1, the hook 321 of the elastic enveloping strap 32 is detached from the corresponding rod 34, and the shade 1 is pushed upward or the rods 34 are pulled upward. The elastic returning force of the elastic element 4 causes rotation of the shaft 2 to automatically coil the shade 1. After the shade 1 reaches the desired extended length, the hook 321 of the elastic enveloping strap 32 reengages with the corresponding rod 34. Thus, the portion of the shade 1 coiled around the shaft 2 can be reliably retained by the elasticity of the elastic enveloping strap 32, thereby retaining the shade 1 in the extended length.

In view of the foregoing, by providing the shade holding device 3, the shade 1 of the coilable shade according to the present disclosure can be controlled to be retained in any desired extended length through simple operation while providing excellent use convenience as well as fulfilling different shielding effects. Thus, the coilable shade has excellent utility.

Thus since the disclosure disclosed herein may be embodied in other specific forms without departing from the spirit or general characteristics thereof, some of which forms have been indicated, the embodiments described herein are to be considered in all respects illustrative and not restrictive. The scope of the disclosure is to be indicated by the appended claims, rather than by the foregoing description, and all changes which come within the meaning and range of equivalency of the claims are intended to be embraced therein.

What is claimed is:

1. A coilable shade comprising:

a shade including a head end and a tail end spaced from the head end in a vertical direction, with the head end including a hanger portion;

a shaft fixed to the tail end of the shade; and a shade holding device including a first lateral board, a second lateral board spaced from the first lateral board in a horizontal direction perpendicular to the vertical direction, a first rod, and a second rod, with a first pivotal portion disposed on an inwardly facing side of the first lateral board, with a second pivotal portion disposed on an inwardly facing side of the second lateral board, with the inwardly facing sides of the first and second lateral boards facing each other, with the shaft coupled to the first and second pivotal portions, wherein a portion of the shade coiled around the shaft is received in the shade holding device and is held by an elastic enveloping strap, with each of the first and second rods including two ends respectively fixed to the first and second lateral boards, with the elastic enveloping strap including a first end fixed between the two ends of the first rod and a second end having a hook detachably coupled between the two ends of the second rod, wherein the elastic enveloping strap directly contacts and supports the portion of shade coiled around the shaft, and wherein a vertical position of the hook in the vertical direction coupled between the two ends of the second rod is changed in response to an extended length of the shade.

2. The coilable shade as claimed in claim 1, wherein the first and second rods are located between the head end of the shade and the first and second pivotal portions in the vertical direction.

3. The coilable shade as claimed in claim 1, further comprising an elastic element including a first end mounted in an interior of the shaft and a second end coupled to one of the first and second pivotal portions.

* * * * *